US008282094B2

(12) United States Patent
Sakakibara et al.

(10) Patent No.: US 8,282,094 B2
(45) Date of Patent: Oct. 9, 2012

(54) DOCUMENT HOLDING TRAY, DOCUMENT CONVEYING APPARATUS, AND IMAGE READING APPARATUS

(75) Inventors: Akihiro Sakakibara, Toyota (JP); Takashi Ohama, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 236 days.

(21) Appl. No.: 11/521,501

(22) Filed: Sep. 15, 2006

(65) Prior Publication Data

US 2007/0057436 A1 Mar. 15, 2007

(30) Foreign Application Priority Data

Sep. 15, 2005 (JP) ..... 2005-268455

(51) Int. Cl.
*B65H 1/00* (2006.01)

(52) U.S. Cl. ..... 271/171

(58) Field of Classification Search ..... 271/171
See application file for complete search history.

(56) References Cited

U.S. PATENT DOCUMENTS

| | | | | | |
|---|---|---|---|---|---|
| 4,494,747 | A | * | 1/1985 | Graef et al. | 271/263 |
| 5,172,903 | A | * | 12/1992 | Haneda et al. | 271/171 |
| 5,297,787 | A | * | 3/1994 | Shirai | 271/171 |
| 5,533,721 | A | * | 7/1996 | Takashimizu | 271/109 |
| 5,845,899 | A | * | 12/1998 | Satoh et al. | 271/9.11 |
| 6,557,757 | B1 | * | 5/2003 | Peebles | 235/379 |
| 7,407,159 | B2 | * | 8/2008 | Tazika | 271/171 |
| 2005/0062218 | A1 | * | 3/2005 | Murakami et al. | 271/171 |

FOREIGN PATENT DOCUMENTS

| | | | | |
|---|---|---|---|---|
| JP | 62-34534 | U | | 2/1987 |
| JP | 2-233420 | A | | 9/1990 |
| JP | 4-79832 | U | | 7/1992 |
| JP | 4-358631 | | * | 12/1992 |
| JP | 6-64759 | | * | 3/1994 |
| JP | 7-251954 | | * | 10/1995 |
| JP | 7-291464 | A | | 11/1995 |
| JP | 8319029 | | | 12/1996 |
| JP | 2000-128362 | | * | 5/2000 |
| JP | 2000-128362 | A | | 5/2000 |
| JP | 2004-035134 | A | | 2/2004 |

OTHER PUBLICATIONS

JP Office Action dtd May 11, 2010, JP Appln. 2005-268455, partial English Translation.

* cited by examiner

*Primary Examiner* — Gerald McClain
*Assistant Examiner* — Thomas A Morrison
(74) *Attorney, Agent, or Firm* — Banner & Witcoff, Ltd.

(57) ABSTRACT

A tray which holds documents to be fed has a document holding portion which holds document in a stacked state thereon and guide members which are arranged on the document holding portion in the cross direction (document width direction) and at least one of which is movable in the document width direction. The document feeding tray further has an extending portion which extends from the document holding portion in the feeding direction (document length direction) to freely increase or decrease the extending amount and a adjusting mechanism which decreases the extending amount of the extending portion as a distance between the guide members becomes narrower and increases the extending portion as the distance between the guide members becomes wider.

6 Claims, 7 Drawing Sheets

DOCUMENT HOLDING TRAY, DOCUMENT CONVEYING APPARATUS, AND IMAGE READING APPARATUS

CROSS-REFERENCE TO RELATED APPLICATIONS

This Nonprovisional application claims priority under 35 U.S.C.§119 (a) on Patent Application No. 2005-268455 filed in Japan on Sep. 15, 2005, the entire contents of which are hereby incorporated by reference.

BACKGROUND OF THE INVENTION

1. Field of the Invention

The present invention relates to a document holding tray on which documents to be fed to, for example, an image reading apparatus can be held in the stacked state, and a document conveying apparatus including such document holding tray, further the image reading apparatus including such document conveying apparatus.

2. Description of Related Art

According to a prior art, in a paper tray which can hold paper in the stacked state thereon, paper guides can be adjusted according to the paper width and the tray length can be also adjusted according to the paper length within an outer frame of the tray, respectively (refer to, for example, Japanese Patent Application Laid-Open No. 8-319029 (1996)).

BRIEF SUMMARY OF THE INVENTION

A document holding tray of a first aspect of the present invention is a tray which holds documents to be fed, and is characterized by comprising: a document holding portion which holds documents in a stacked state thereon; guide members which are arranged on said document holding portion and separately in a cross direction crossing to a feeding direction of the documents, and at least one of said guide members is configured to be movable on said document holding portion in said cross direction; an extending portion which extends from said document holding portion and whose extending amount changes with respect to said document holding portion in said feeding direction; an adjusting mechanism which decreases the extending amount of said extending portion as a distance between said guide members becomes narrower, and increases the extending amount of said extending portion as the distance between said guide members becomes wider.

According to the document holding tray of the first aspect of the present invention, as the document held on the document holding portion becomes larger in size, the area on which the document can be held (the sum of the area of the document holding portion and the area of the extending portion) becomes larger. On the contrary, as the document held on the document holding portion becomes smaller in size, the area on which the document can be held becomes smaller. That is, by adjusting the guide members according to the document width, the length of the document holding tray is automatically changed to minimum necessary size.

A document conveying apparatus of a second aspect of the present invention is characterized by including: the above-mentioned document holding tray; a conveying mechanism which conveys the document fed from said tray; and a discharged paper tray to which documents conveyed by said conveying mechanism are discharged.

An image reading apparatus of a third aspect of the present invention is characterized by including: an image reading unit which reads a document; the above-mentioned document holding tray; a conveying mechanism which conveys the document fed from said tray via an image reading position where said image reading unit reads the documents; and a discharged paper tray to which documents conveyed by said conveying mechanism are discharged.

The above and further objects and features of the invention will more fully be apparent from the following detailed description with accompanying drawings.

BRIEF DESCRIPTION DF THE SEVERAL VIEWS OF THE DRAWINGS

DETAILED DESCRIPTION OF THE PRESENT INVENTION

The present invention will be described below with reference to figures showing embodiments.

First Embodiment

Figure 1:
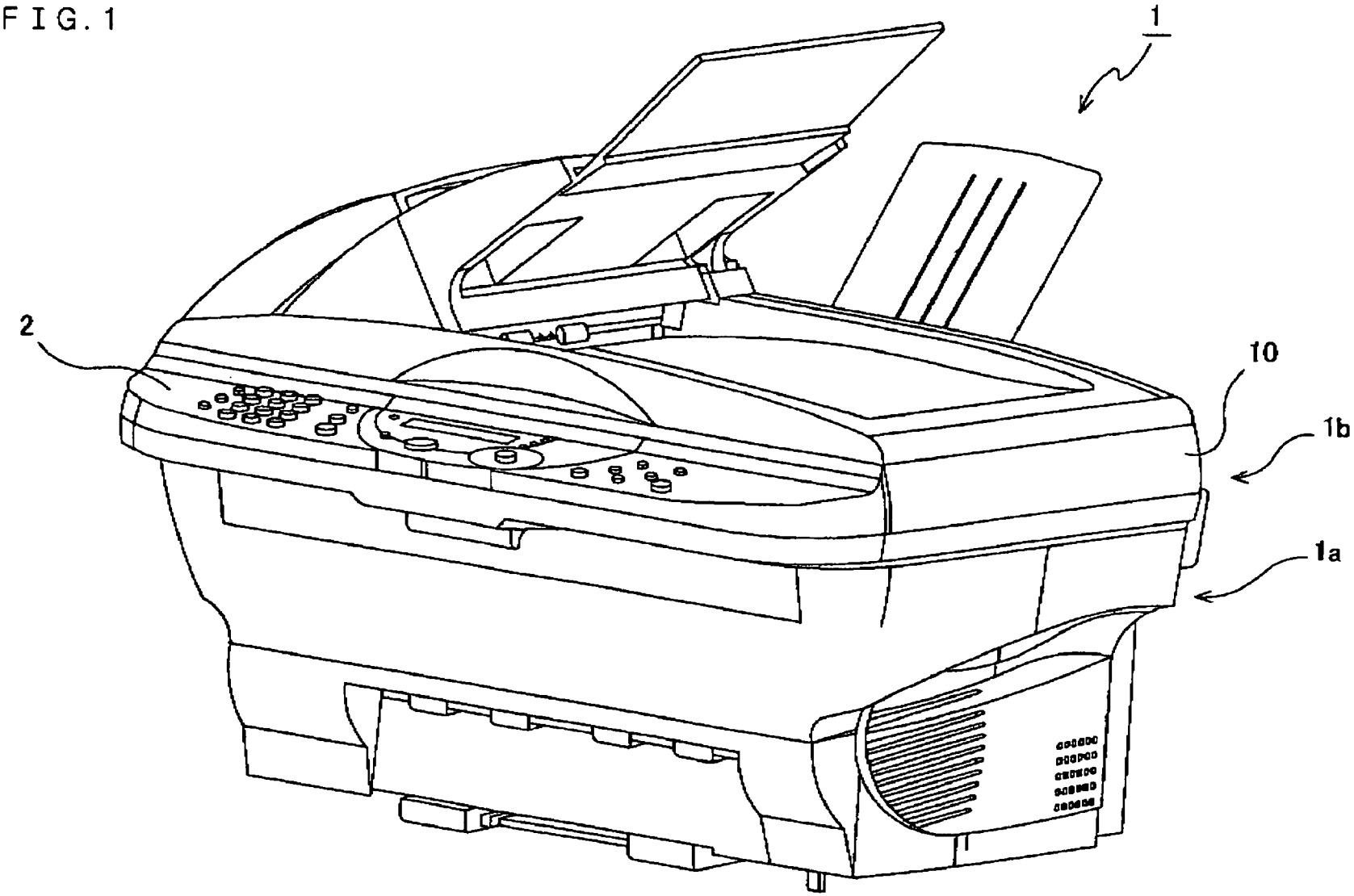
FIG. 1 is a schematic view showing appearance of a multi function device (MFD) into which an image reading apparatus according to the present invention having a document holding tray according to the present invention is incorporated.

FIG. 1 is a schematic view showing appearance of a composite apparatus (multi function device: MFD) into which an image reading apparatus according to the present invention having a document holding tray according to the present invention is built in. Hereinafter, the composite apparatus is referred to as an MFD. A document conveying apparatus according to the present invention is built in the image reading apparatus.

As shown in FIG. 1, the MFD 1 has a clam shell structure in which an upper body 1*b* is openably attached to a lower body 1*a*. The upper body 1*b* has the image reading apparatus 10. An operation panel 2 is provided on a front surface side of the upper body 1*b*. The MFD 1 has a laser printer type image forming apparatus, a facsimile apparatus and the like in addition to the image reading apparatus 10. However, since these apparatuses are not directly related to the present invention, description thereof is omitted.

Figure 2:
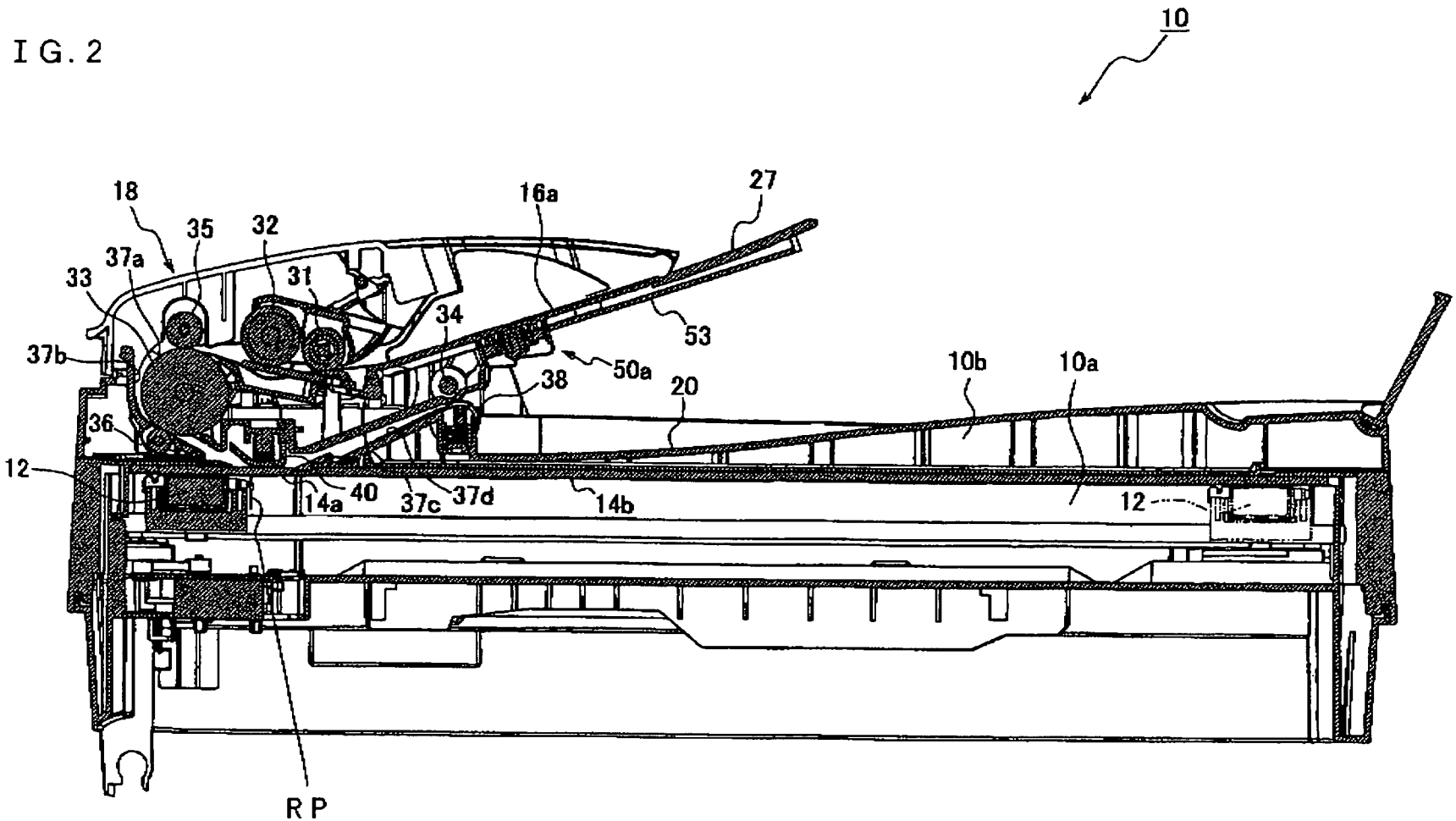
FIG. 2 is a side sectional view of the image reading apparatus according to the present invention in the cross direction in FIG. 1.

FIG. 2 is a side sectional view of the image reading apparatus 10 according to the present invention in the cross direction in FIG. 1.

As shown in FIG. 2, the image reading apparatus 10 has both of a flat bed unit 1*a* and an automatic document feeder (ADF). The image reading apparatus 10 itself has a clam shell structure in which a cover unit 10*b* is openably attached to the flat bed unit 10*a*.

A contact type image sensor (reading head) 12 as an image reading unit, a first platen glass 14*a* and a second platen glass 14*b* are provided on the flat bed unit 10*a* of the image reading apparatus 10. The cover unit 10*b* is provided with a document conveying apparatus 18. The document conveying apparatus 18 is provided with a document feeding tray 16*a* as the document holding tray of the present invention, a discharged paper tray 20.

The image sensor 12 has a light emitting unit (not shown) and a light receiving unit (not shown) using a photoelectric conversion element. The image sensor 12 reads an image by irradiating the document on the first platen glass 14*a* or the second platen glass 14*b* with light from the light emitting unit and receiving light reflected on the document by the light receiving unit.

The image sensor 12 is driven in the cross direction in FIG. 2 by a driving mechanism not shown. When the document conveyed by the ADF is read, the light receiving unit of the image sensor 12 moves to a position just under a reading position RP (refer to FIG. 2).

The document conveying apparatus 18 has a feeding roller 32 for separating the documents stacked on the document feeding tray 16*a* from each other and feeding one by one, a sucking roller 31 for guiding the document to the feeding roller 32, a conveying roller 33 for the document fed by the feeding roller 32 along a conveying path (a path formed of guiding members 37*a* through 37*d*, the first platen glass 14*a* and the like) and a discharging roller 34 for discharging the document conveyed by the conveying roller 33 to the discharged paper tray 20.

Also, the document conveying apparatus 18 has free rollers 35, 36 which is disposed as opposed to the conveying roller 33 and rotate with rotation of the conveying roller 33 and a free roller 38 which is disposed as opposed to the discharging roller 34 and rotate with rotation of the discharging roller 34. The sucking roller 31, the feeding roller 32, the conveying roller 33 and the discharging roller 34 forms a conveying mechanism.

The document conveying apparatus 18 further has a pressing member 40 located as opposed to the first platen glass 14*a*. This pressing member 40 prevents floating of the document at the reading position RP by holding the document between the pressing member and the first platen glass 14*a*.

Figure 3A:
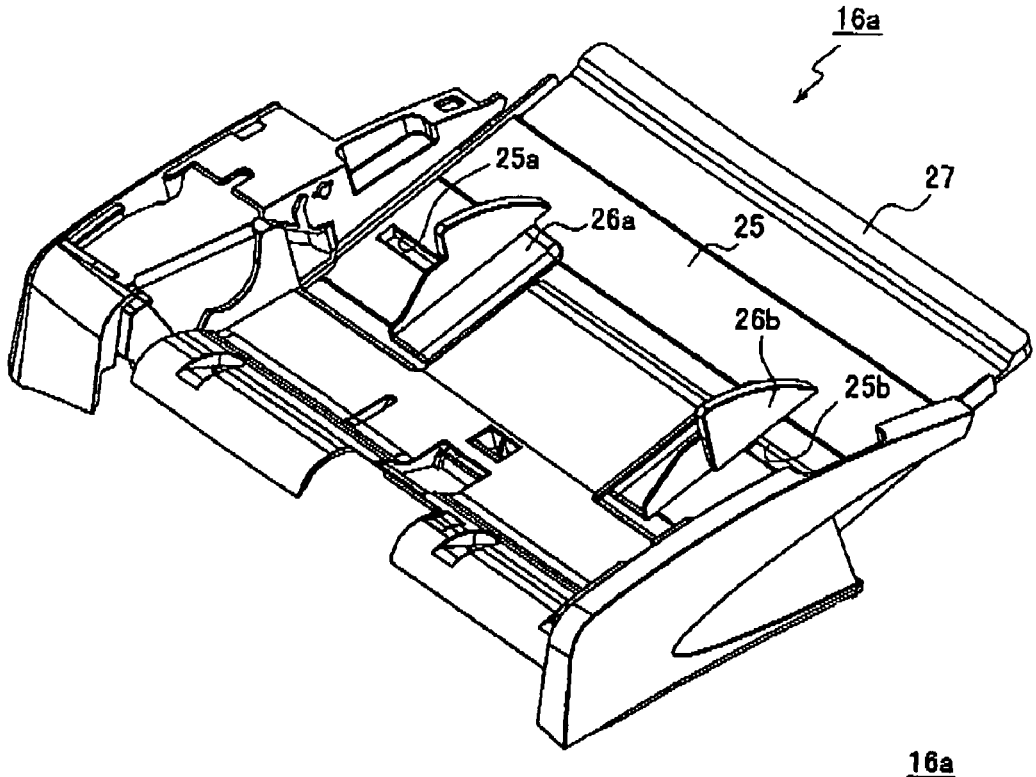
FIG. 3A and FIG. 3B are schematic views showing appearance of a document holding tray in a first embodiment viewed from diagonally above.
Figure 3B:
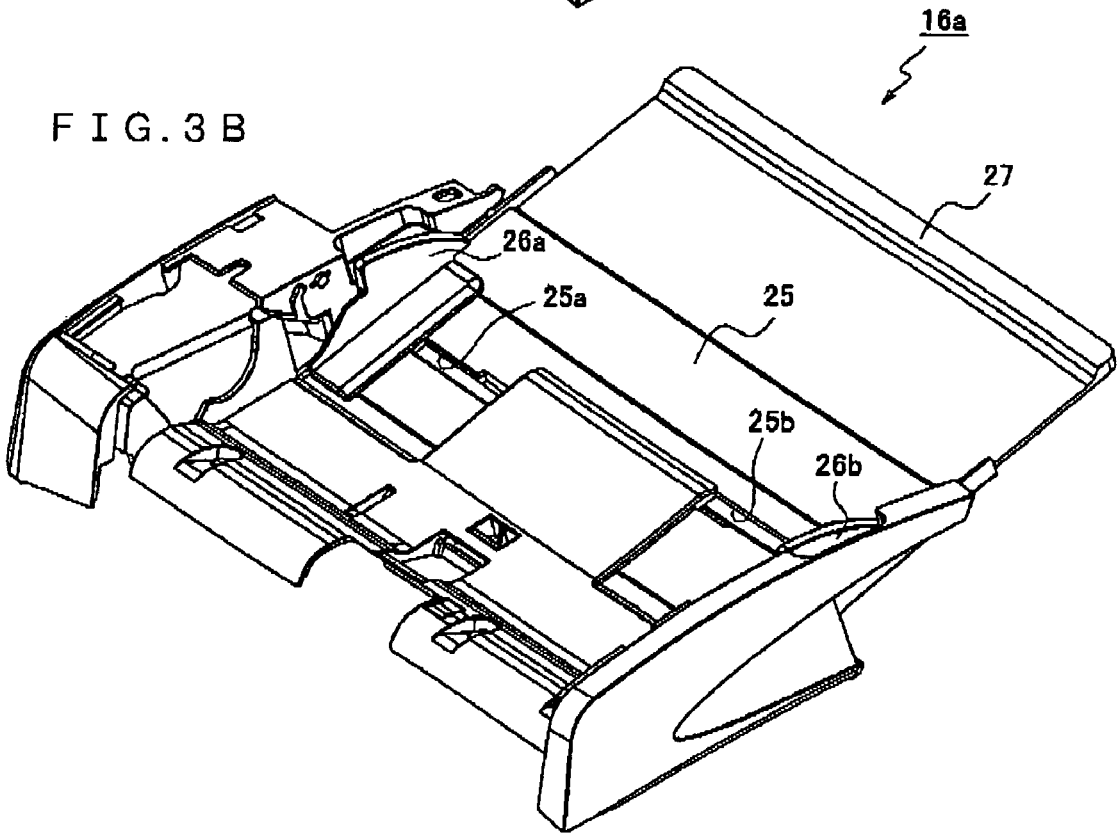

Next, the document feeding tray 16*a* will be described with reference to FIG. 3A and FIG. 3B. FIG. 3A and FIG. 3B are schematic views showing appearance of the document feeding tray 16*a* viewed from diagonally above. FIG. 3A shows a document guide opened state (a state in which a distance between document guides 26*a*, 26*b* described later is relatively narrow) and FIG. 3B shows a document guide closed state (a state in which a distance between the document guides 26*a*, 26*b* is relatively wide).

The document feeding tray 16*a* has a document holding portion 25 for holding documents in the stacked state thereon, document guide 26*a*, 26*b* as two guide members arranged on the document holding portion 25, and an extending portion 27. The two document guides 26*a*, 26*b* each has, as main components, a guide plane which is parallel to the document feeding direction (hereinafter, this direction is referred to as a length direction regarding the document feeding tray 16*a* or the document holding portion 25) and substantially perpendicular to a surface of the document holding portion 25, and a base portion which is connected to the guide plane and is parallel to the surface of the document holding portion 25. By a link mechanism described later, both of the document guides 26*a*, 26*b* can be moved so as to separate from each other or approach with each other in the cross direction substantially perpendicular to the document feeding direction (hereinafter, this direction is referred to as a width direction regarding the document feeding tray 16*a* or the document holding portion 25).

One end portion (an end portion on the document holding portion 25 side) of the extending portion 27 is supported by a supporting portion 25*c* (refer to FIG. 4A and FIG. 4B) provided on an under surface of an end portion of the document holding portion 25 on the opposite side to the document feeding side (hereinafter referred to as an expansion-side end portion). The supporting portion 25*c* is formed of a band-like member disposed in parallel with the under surface of the expansion-side end portion of the document holding portion 25 with an appropriate distance therebetween over the substantially entire length of the document holding portion 25 in the width direction. The extending portion 27 is supported with its one end portion being inserted into a space formed on the under surface of the document holding portion 25 by the supporting portion 25*c* so as to be movable relative to the document holding portion 25 in the document length direction. Thus, an extension length from the document holding portion 25 changes as the one end portion of the extending portion 27 moves in the supporting portion 25*c* formed on the under surface of the end portion of the document holding portion 25. As a result, it looks as if the document holding portion 25 can be expandable.

Grooves 25*a*, 25*b* for moving the document guides 26*a*, 26*b*, respectively, are formed on the document holding portion 25 in the document width direction. Apart of each document guide 26*a*, 26*b* is formed to be adapted to engage with the grooves 25*a*, 25*b*, respectively. Thus, the document guides 26*a*, 26*b* can move along the grooves 25*a*, 25*b*, respectively, in the document width direction which is the direction perpendicular to the document feeding direction and thickness direction, that is, in the width direction of the document holding portion 25.

Figure 4A:
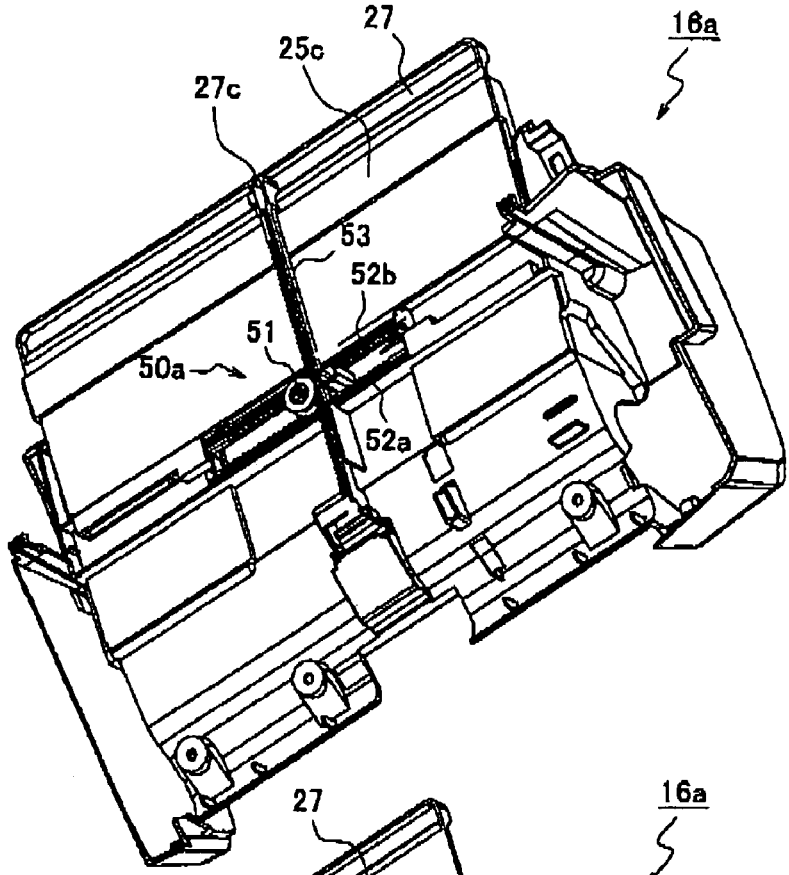
FIG. 4A and FIG. 4B are schematic views showing appearance of the document holding tray in the first embodiment viewed from diagonally below.
Figure 4B:
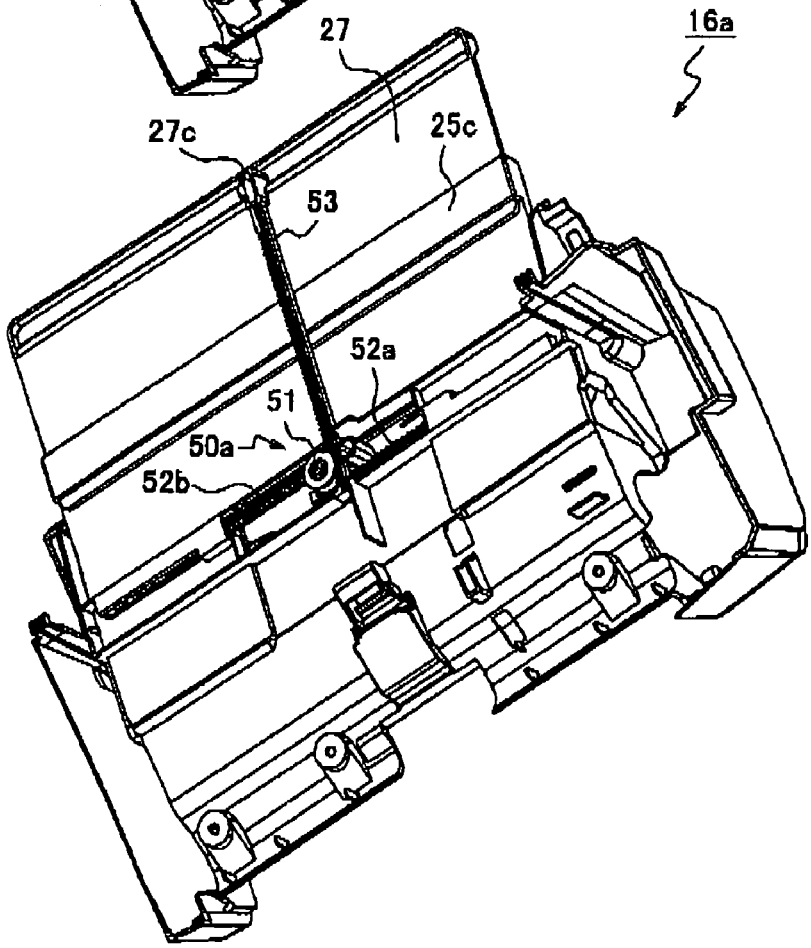
Figure 5:
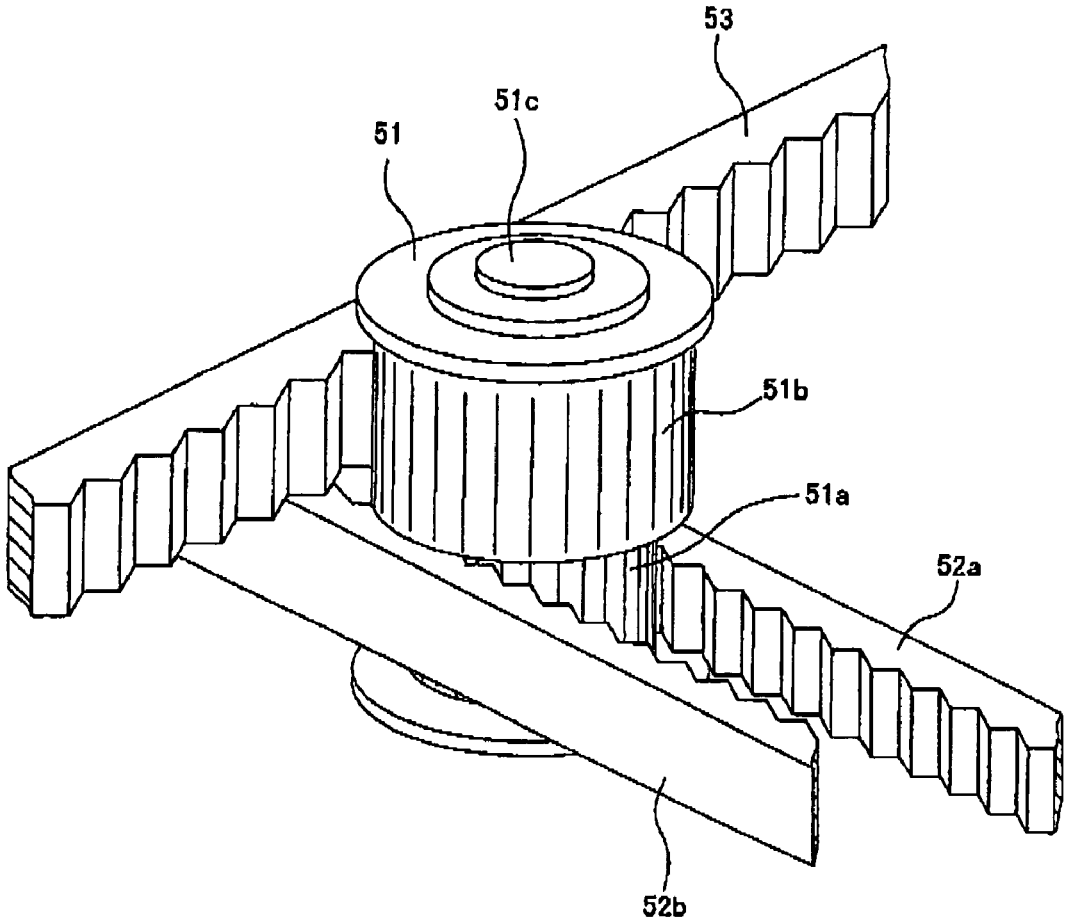
FIG. 5 is a schematic enlarged view of a pinion gear in a link mechanism in the first embodiment.

Next, the link mechanism 50*a* as an adjusting mechanism for change the extending amount of the extending portion 27 (expanding or contracting the extending portion 27) with movement of the document guides 26*a*, 26*b* will be described with reference to FIG. 4A, FIG. 4B and FIG. 5. FIG. 4A and FIG. 4B are schematic views showing appearance of the document feeding tray 16*a* viewed from diagonally below. FIG. 4A shows the document guide closed state and FIG. 4B shows the document guide opened state. FIG. 5 is a schematic enlarged view showing a pinion gear 51 in the link mechanism 50*a*.

The document feeding tray 16*a* has the link mechanism 50*a*. The link mechanism 50*a* is configured by a left side open-close rack 52*a* as a first rack, a right side open-close rack 52*b* as a first rack, which is disposed in parallel with the left side open-close rack 52*a*, an expanding rack 53 as a second rack which is disposed perpendicular to both the open-close racks 52*a*, 52*b* and the pinion gear 51 meshing with the racks 52*a*, 52*b* and 53.

The pinion gear 51, as shown in FIG. 5, includes a first pinion gear 51*a* and a second pinion gear 51*b* both having a common rotational shaft 51*c* and different diameters. The first pinion gear 51*a* and the second pinion gear 51*b* is integrally rotated.

Figure 7A:
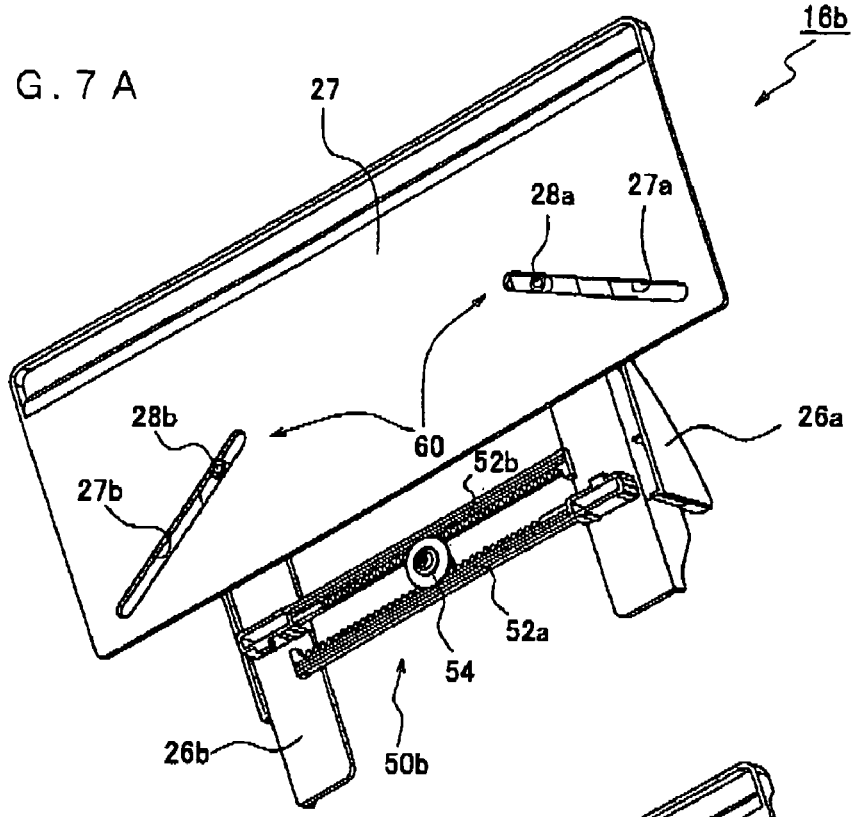
FIG. 7A and FIG. 7B are schematic views showing appearance of the document holding tray in the second embodiment viewed from diagonally below.
Figure 7B:
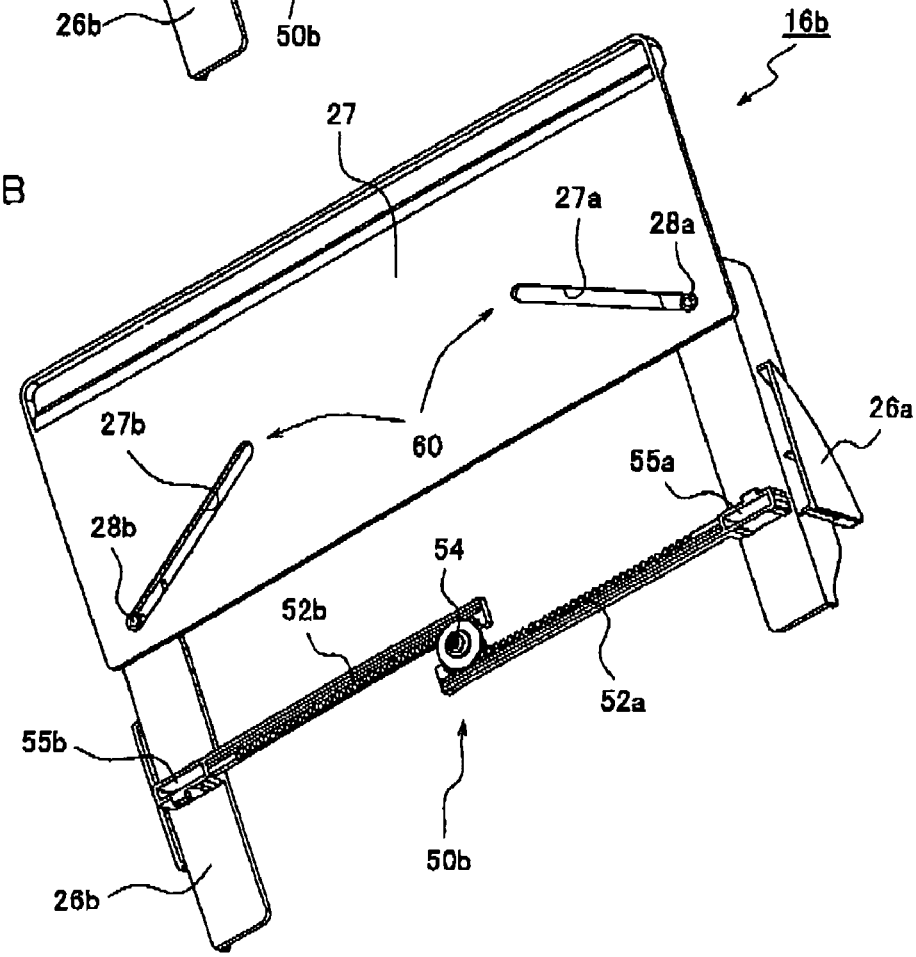

The left side open-close rack 52*a* is fixed to the document guide 26*a* at a rack fixing portion 55*a* provided on the document guide 26*a* (refer to FIG. 7B). The right side open-close rack 52*b* is fixed to the document guide 26*b* at a rack fixing portion 55*b* provided on the document guide 26*b* (refer to FIG. 7B).

The left side open-close rack 52*a* and the right side open-close rack 52*b* are disposed as opposed to each other sandwiching the first pinion gear 51*a* and meshed with the first pinion gear 51*a*. Accordingly, one of the open-close rack 52*a* and the right side open-close rack 52*b* moves, the first pinion gear 51*a* rotates and the other of the open-close rack 52*a* and the right side open-close rack 52*b* moves in the opposite direction.

The left side open-close rack 52*a* and right side open-close rack 52*b* are set to mesh with the first pinion gear 51*a* at a position where a distance between the center of the document width direction and the document guide 26*a* may be equal to a distance between the center of the document width direction and the document guide 26*b*. For this reason, by rotation of the first pinion gear 51*a*, when one of the document guides 26*a*, 26*b* moves along the groove 25*a* or 25*b*, the other of the document guides 26*b*, 26*a* follows the movement and moves in the opposite direction under a state where a distance between the center of the document width direction and the document guide 26*a* may be equal to a distance between the center of the document width direction and the document guide 26*b*.

Therefore, in the document feeding tray 16*a* as described above, the document guide closed state as shown in FIG. 3A (in the state where the distance between the document guides 26*a*, 26*b* is smallest, that is, the narrowest document is held) and the document guide opened state as shown in FIG. 3B (in the state where the distance between the document guides 26*a*, 26*b* is largest, that is, the widest document is held) can be arbitrarily adopted. Alternatively, an intermediate state between these states can be adopted.

The expanding rack 53, as shown in FIG. 4, is fixed to the extending portion 27 at the rack fixing portion 27*c* provided on the other end portion of the extending portion 27 (an end portion on the opposite side to the document holding portion 25 side). As mentioned above, the expanding rack 53 meshes with the second pinion gear 51*b*.

Next, movements of the extending portion 27 when the document guides 26*a*, 26*b* move will be described.

When the document guide closed state as shown in FIG. 3A shifts to the document guide opened state as shown in FIG. 3B, the pinion gear 51 rotates in the counterclockwise direction in FIG. 4A, FIG. 4B and FIG. 5 due to movement of both the open-close racks 52*a*, 52*b* which is caused by movement of at least one of the document guides 26*a* and 26*b*. At this time, since the first pinion gear 51*a* and the second pinion gear 51*b* integrally rotates, with rotation of the second pinion gear 51*b*, the expanding rack 53 moves in the direction in which the extending portion 27 extends from the document holding portion 25. As a result, since the extending amount of the extending portion 27 from the document holding portion 25 becomes larger, a space for holding the document therein, specifically the sum of the area of the document holding portion 25 and the area of the extending portion 27 becomes larger.

On the other hand, when the document guide opened state as shown in FIG. 3B shifts to the document guide closed state as shown in FIG. 3A, the pinion gear 51 rotates in the clockwise direction in FIG. 4A, FIG. 4B and FIG. 5 due to movement of both the open-close racks 52*a*, 52*b* which is caused by movement of at least one of the document guides 26*a* and 26*b*. At this time, since the first pinion gear 51*a* and the second pinion gear 51*b* integrally rotates in the opposite direction to that in the above-mentioned case, with rotation of the second pinion gear 51*b*, expanding rack 53 moves in the direction in which the extending amount of the extending portion 27 from the document holding portion 25 is smaller. As a result, since the extending amount of the extending portion 27 from the document holding portion 25 becomes smaller, the space for holding the document therein, specifically the sum of the area of the document holding portion 25 and the area of the extending portion 27 becomes smaller.

By the way, the second pinion gear 51*b* has a larger diameter than the first pinion gear 51*a*. As a specific example, preferably, a ratio between the pinion gears 51*a* and 51*b* in pitch diameter is set as $1:\sqrt{2}$. The reason is that the documents often used in the MFD 1 each have a fixed size such as A4, A3, B4 and B5 and their ratio of length and width is $1:\sqrt{2}$. That is, by setting the ratio between the open-close racks 52*a* and 52*b* in movement as the ratio between length and width of general documents, the extending portion 27 can be automatically changed (expanded or contracted) by an appropriate area according to the width of the standard-size documents.

In the first embodiment described above, the document feeding tray 16*a* has the document holding portion 25 for holding the document to be fed to the image reading unit (reading position RP of the image sensor 12) in the stacked state thereon and a plurality of document guide 26*a*, 26*b* which are arranged on both sides of the document held on the document holding portion 25 in the document width direction and at least one of which can be moved according to the width of the document. The document feeding tray 16*a* further has the extending portion 27 which moves in the longitudinal direction with respect to the document holding portion 25, thereby changing the extending amount from the document holding portion 25 and the link mechanism 50*a* which makes the extending amount of the extending portion 27 smaller as the distance between the document guides 26*a*, 26*b* becomes narrower and makes the extending amount of the extending portion 27 larger as the distance between the document guides 26*a*, 26*b* becomes wider.

Accordingly, with such document feeding tray 16*a*, it is possible to automatically make the area on which the document can be held (the sum of the area of the document holding portion 25 and the area of the extending portion 27) larger as the size of the document held on the document holding portion 25 becomes larger as well as to automatically make the area on which the document can be held (the sum of the area of the document holding portion 25 and the area of the extending portion 27) smaller as the size of the document held on the document holding portion 25 becomes smaller. In other words, by adjusting the document guides 26*a*, 26*b* to the width of the document, the outside shape of the document feeding tray 16*a* can be changed to have the minimum necessary size.

In the document feeding tray 16*a* in the first embodiment, the link mechanism 50*a* has the left side open-close rack 52*a* and the right side open-close rack 52*b* which moves in the document width direction in connection with movement of the movable document guides 26*a*, 26*b*, the pinion gear 51 rotating in connection with movement of the left side open-close rack 52*a* and the right side open-close rack 52*b*, and the expanding rack 53 which is at least partially fixed to the extending portion 27 and moves in the document length direction in connection with rotation of the pinion gear 51. Then, according to movement of the expanding rack 53, the link mechanism 50*a* makes the extending amount of the extending portion 27 change (expands or contracts) with respect to the document holding portion 25.

Thus, since the document feeding tray 16*a* adopts a rack and pinion mechanism, distinct from the case of adopting a driving mechanism using a belt, the extending amount of the extending portion 27 can be changed (expanded or contracted) according to the document width without generating sliding.

Furthermore, in the document feeding tray 16*a* in the first embodiment, the pinion gear 51 has the first pinion gear 51*a* which meshes with the left side open-close rack 52*a* and the right side open-close rack 52*b*, and the second pinion gear 51*b* which rotates with rotation of the first pinion gear 51*a* and meshes with the expanding rack 53.

Thus, with such document feeding trays 16*a*, by arbitrarily setting the number of teeth of the first pinion gear 51*a* and the second pinion gear 51*b*, the extending amount of the extending portion 27 can be automatically changed (expanded or contracted) according to the ratio between width and length of the document.

The MFD 1 in the first embodiment has the document feeding tray 16*a*, the image sensor 12 for reading the document, the discharged paper tray 20 which is disposed under the document feeding tray 16*a* and holds the documents in the stacked state after image reading by the image sensor, and various rollers 31 through 34 for conveying the document held on the document holding portion 25 to the discharged paper tray 20 via the reading position RP at which the document is read by the image sensor 12.

Thus, in the MFD 1, although the discharged paper tray 20 is disposed under the document holding portion 25, since the extending portion 27 extending from the document holding portion 25 changes the extending amount according to the document size as described above, even when the document size is small, the operator can easily take the documents stacked on the discharged paper tray 20. Furthermore, since the document can be prevented from protruding from the document holding portion 25 and the extending portion 27 even when the document size is large, it is possible to avoid any conveying error, for example, the document is not fed or separated.

Second Embodiment

Next, a second embodiment of the present invention will be described. The second embodiment is different from the first embodiment only in configuration of a part of the document feeding tray and is the same as the first embodiment in other configuration. Therefore, in the following description of the second embodiment, only components different from the first embodiment will be described and the same reference numerals are given to the components similar to the first embodiment and description thereof is omitted. In the second embodiment, the document feeding tray is represented by a reference numeral 16*b*.

Figure 6A:
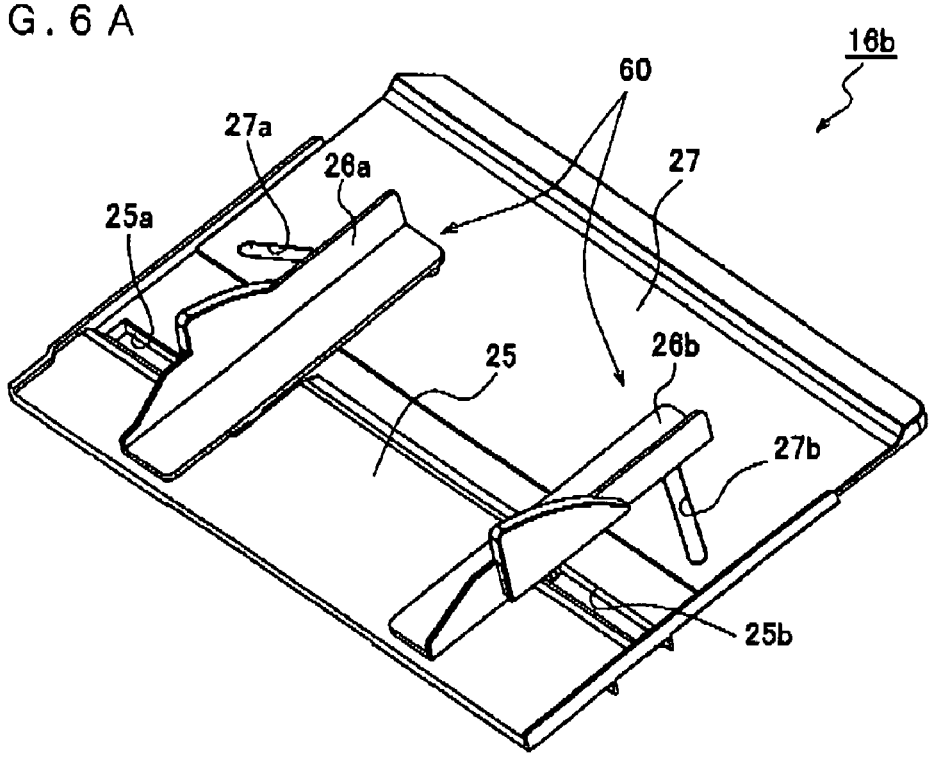
FIG. 6A and FIG. 6B are schematic views showing appearance of a document holding tray in a second embodiment viewed from diagonally above.
Figure 6B:
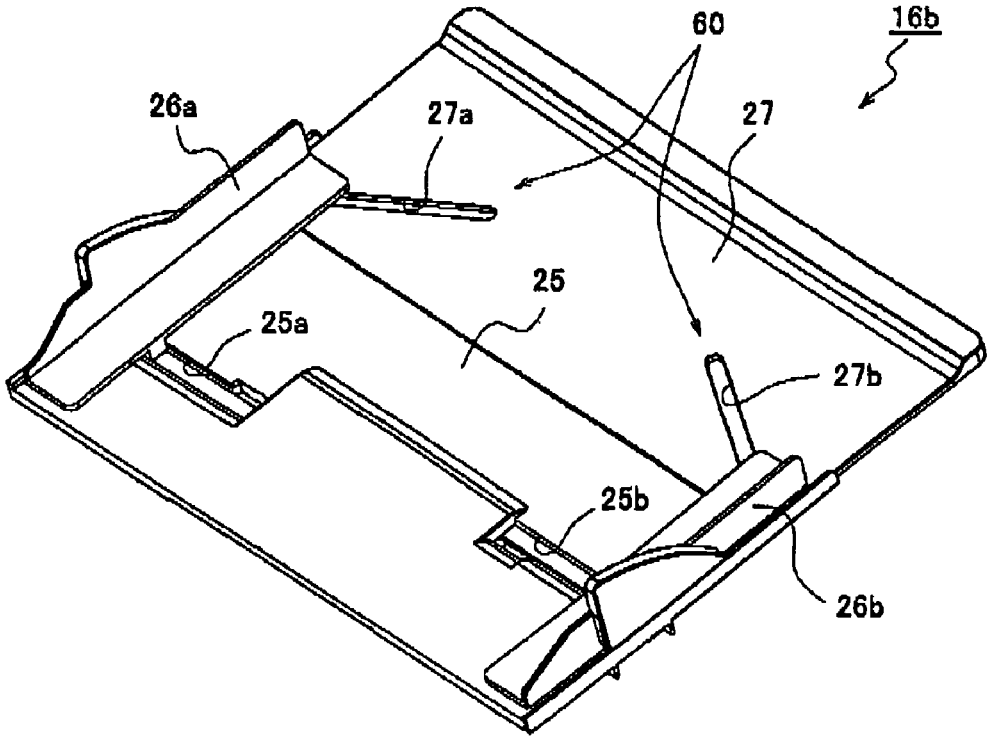

The document feeding tray 16*b* in the second embodiment will be described with reference to FIG. 6A, FIG. 6B, FIG. 7A, FIG. 7B. FIG. 6A and FIG. 6B are schematic views showing appearance of the document feeding tray 16*a* viewed from diagonally above. FIG. 6A shows the document guide closed state and FIG. 6B shows the document guide opened state. FIG. 7A and FIG. 7B are schematic views showing appearance of the document feeding tray 16*a* viewed from diagonally below. FIG. 7A shows the document guide closed state and FIG. 7B shows the document guide opened state.

The document feeding tray 16*b* in the second embodiment, as shown in FIG. 6A and FIG. 6B, has a sliding mechanism 60 as the adjusting mechanism for changing (expanding or contracting) the extending amount of the extending portion 27 with respect to the document holding portion 25.

The sliding mechanism 60 is configured by protruding portions 28*a*, 28*b* protruding from the document guides 26*a*, 26*b*, respectively, to the document holding portion 25 side and long holes 27*a*, 27*b* which engage with the protruding portion 28*a*, 28*b*, respectively, and are formed on the extending portion 27.

The long holes 27*a*, 27*b* formed on the extending portion 27 are inclined relative to the width direction in which the document guides 26*a*, 26*b* each can move. That is, the long holes 27*a*, 27*b* are formed at the extending portion 27 diagonally from the outer side toward the inner side in the width direction so that the distance therebetween on the document holding portion 25 side may be wide, and, as the long holes 27*a*, 27*b* are separate from the document holding portion 25, may become narrower.

In such sliding mechanism 60, when the document guide 26*a*, 26*b* each move in the document width direction, the protruding portion 28*a*, 28*b* also move in the width direction. As a result, the protruding portion 28*a*, 28*b* each move along the long holes 27*a*, 27*b*, thereby sliding the extending portion 27 in the longitudinal direction of the document holding portion 25. That is, the document guide closed state shown in FIG. 7A shifts to the document guide opened state shown in FIG. 7B, the sliding mechanism 60 increases the extending amount of the extending portion 27 with respect to the document holding portion 25. On the other hand, the document guide opened state shown in FIG. 7B shifts to the document guide closed state shown in FIG. 7A, the sliding mechanism 60 decreases the extending amount of the extending portion 27 with respect to the document holding portion 25.

Since the document feeding tray 16*b* in the second embodiment is adapted to change the extending amount of the extending portion 27 (expand or contract the extending portion 27) by use of the sliding mechanism 60, the link mechanism 50*b* in the second embodiment does not have a function of changing the extending amount of the extending portion 27 (expanding or contracting the extending portion 27).

That is, although the link mechanism 50*b* in the second embodiment has the above-mentioned left side open-close rack 52*a*, the right side open-close rack 52*b* and the pinion gear 54, the link mechanism 50*b* has no expanding rack 53 provided in the link mechanism 50*a* of the first embodiment.

The pinion gear 54 in the second embodiment is formed of a gear meshing with only the left side open-close rack 52*a* and the right side open-close rack 52*b* (first pinion gear 51*a* of the pinion gear 51 in the first embodiment) and is not configured in a two stages like the pinion gear 51 in the first embodiment.

Also in such link mechanism 50*b* in the second embodiment, when one of the document guides 26*a*, 26*b* moves along the grooves 25*a*, 25*b*, the other of the document guides 26*a*, 26*b*, following this movement, also moves in the opposite direction as in the first embodiment.

In the document feeding tray 16*b* in the second embodiment, the sliding mechanism 60 has the protruding portion 28*a*, 28*b* which protrude from the movable document guides 26*a*, 26*b*, respectively, and moves in the document width direction with movement of the document guides 26*a*, 26*b*, and long holes 27*a*, 27*b* which are formed on the extending portion 27 in the extending direction diagonally from the outer side toward the inner side in the document width direction and engage with the protruding portion 28*a*, 28*b*, respectively. Also, in the sliding mechanism 60, the protruding portion 28*a*, 28*b* each move along the long holes 27*a*, 27*b*, respectively, thereby changing (expanding or contracting) the extending amount of the extending portion 27 with respect to the document holding portion 25.

That is, in the document feeding tray 16*b* in the second embodiment, when the document guides 26*a*, 26*b* move in the document width direction, the protruding portions 28*a*, 28*b* each move along the long holes 27*a*, 27*b*, respectively, while changing (expanding or contracting the extending amount of the extending portion 27 with respect to the document holding portion 25.

Therefore, according to the document feeding trays 16*a*, 16*b* in the second embodiment, a mechanism for changing (expanding or contracting) the extending amount of the extending portion 27 with respect to the document holding portion 25 can be achieved with more simple configuration than the configuration of the first embodiment.

Modified Embodiments

Embodiments of the present invention are not limited to the above-mentioned embodiments and may be variously modified as long as they do not deviate from the technical field of the present invention.

For example, both the document feeding trays 16*a*, 16*b* in the first and second embodiments are configured so as to be movable.

However, the document guide 26*a*, for example, may be fixed at the document guide opened state (refer to FIG. 3B, etc.) and only the document guide 26*b* may be movable.

In this case, the left side open-close rack 52*a* becomes unnecessary.

In the link mechanism 50*a* in the first embodiment, the two pinion gears 51*a*, 51*b* are formed integrally on the common rotational shaft of the pinion gear 51. However, the pinion gears 5*ia*, 51*b* are not necessarily disposed on the same shaft and may be disposed so as to mesh with each other. In addition, in the case where the ratio of movement between the open-close racks 52*a*, 52*b* and the expanding rack 53 need not be different, the pinion gear 51 may not necessarily be formed in two-stage configuration, but in one-stage configuration.

Even with such configuration, as a matter of course, it is possible to expand or contract the extending portion 27 with movement of the document guides 26*a*, 26*b*, that is, change the extending amount of the extending portion 27 with respect to the document holding portion 25.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A tray which holds documents to be fed, comprising:

a document holding portion which holds documents in a stacked state thereon;

guide members which are arranged on said document holding portion and separately in a cross direction crossing to a feeding direction of the documents, and movable on said document holding portion in said cross direction;

an extending portion which extends from said document holding portion, wherein an extending amount of the extending portion changes with respect to said document holding portion by expanding or contracting in said feeding direction;

an adjusting mechanism which decreases the extending amount of said extending portion as a distance between said guide members becomes narrower, and increases the extending amount of said extending portion as the distance between said guide members becomes wider;

wherein said adjusting mechanism further comprises:

protruding portions which respectively protrude from said movable guide members, and respectively move in said cross direction with movement of said movable guide members; and long linear holes which are respectively formed on said extending portion in said feeding direction diagonally from an outer side toward an inner side in said cross direction, and respectively engage with said protruding portions, wherein the entire shape of each long linear hole is linear;

wherein the extending amount of said extending portion changes by moving said protruding portions along said long linear holes in connection with movement of said movable guide members, wherein said extending portion holds a bottom surface of the documents in the stacked state together with said document holding portion, wherein said extending portion is disposed between the guide members and a top surface of the document holding portion where documents are stacked, and wherein the total size of the tray is changed in accordance with the extending amount of the extending portion.

2. The tray according to claim 1, wherein a width of a part extending from said document holding portion of said extending portion in said cross direction is longer than a length between said guide members in the case that said guide members are furthest from each other in said cross direction.

3. A document conveying apparatus including:

a tray which holds documents to be fed and comprises:

a document holding portion which holds documents in a stacked state thereon;

guide members which are arranged on said document holding portion and separately in a cross direction crossing to a feeding direction of the documents, and movable on said document holding portion in said cross direction;

an extending portion which extends from said document holding portion, wherein an extending amount of said extending portion changes with respect to said document holding portion by expanding and contracting in said feeding direction;

an adjusting mechanism which decreases the extending amount of said extending portion as a distance between said guide members becomes narrower, and increases the extending amount of said extending portion as the distance between said guide members becomes wider;

wherein said adjusting mechanism comprises:

protruding portions which respectively protrude from said movable guide members, and respectively move in said cross direction with movement of said movable guide members; and long linear holes which are respectively formed on said extending portion in said feeding direction diagonally from an outer side toward an inner side in said cross direction, and respectively engage with said protruding portions, wherein the entire shape of each long linear hole is linear;

wherein the extending amount of said extending portion changes by moving said protruding portions along said long linear holes in connection with movement of said movable guide members; and a conveying mechanism which conveys the document fed from said tray; and a discharged paper tray to which documents conveyed by said conveying mechanism are discharged, wherein said extending portion holds a bottom surface of the documents in the stacked state together with said document holding portion, wherein said expending portion is disposed between the guide members and a top surface of the document holding portion where documents are stacked, and wherein the total size of the tray is changed in accordance with the extending amount of the extending portion.

4. The document conveying apparatus according to claim 3, wherein a width of a part extending from said document holding portion of said extending portion in said cross direction is longer than a length between said guide members in the case that said guide members are furthest from each other in said cross direction.

5. An image reading apparatus including:

an image reading unit which reads a document;

a tray which holds documents to be fed to said image reading unit and comprises:

a document holding portion which holds documents in a stacked state thereon;

guide members which are arranged on said document holding portion and separately in a cross direction crossing to a feeding direction of the documents, and movable on said document holding portion in said cross direction;

an extending portion which extends from said document holding portion, wherein an extending amount of said extending portion changes with respect to said document holding portion by expanding and contracting in said feeding direction;

an adjusting mechanism which decreases the extending amount of said extending portion as a distance between said guide members becomes narrower, and increases the extending amount of said extending portion as the distance between said guide members becomes wider;

wherein said adjusting mechanism comprises:

protruding portions which respectively protrude from said movable guide members, and respectively move in said cross direction with movement of said movable guide members; and long linear holes which are respectively formed on said extending portion in said feeding direction diagonally from an outer side toward an inner side in said cross direction, and respectively engage with said protruding portions, wherein the entire shape of each long linear hole is linear;

wherein the extending amount of said extending portion changes by moving said protruding portions along said long linear holes in connection with movement of said movable guide members;

a conveying mechanism which conveys the document fed from said tray via an image reading position where said image reading unit reads the documents; and a discharged paper tray to which documents conveyed by said conveying mechanism are discharged, wherein said extending portion holds a bottom surface of the documents in the stacked state together with said document holding portion, wherein said extending portion is disposed between the guide members and a top surface of the document holding portion where documents are stacked, and wherein the total size of the tray is changed in accordance with the extending amount of the extending portion.

6. The image reading apparatus according to claim 5, wherein a width of a part extending from said document holding portion of said extending portion in said cross direction is longer than a length between said guide members in the case that said guide members are furthest from each other in said cross direction.

* * * * *